United States Patent [19]

Sadler

[11] 4,095,220

[45] June 13, 1978

[54] ALARM DETECTION AND IDENTIFICATION SYSTEM

[76] Inventor: Joe A. Sadler, 327 Main St., Humble, Tex. 77338

[21] Appl. No.: 715,316

[22] Filed: Aug. 18, 1976

[51] Int. Cl.[2] ..... G08B 19/00

[52] U.S. Cl. ..... 340/409; 340/52 F; 340/172; 340/412

[58] Field of Search ..... 340/52 F, 164 R, 172, 340/213 R, 408, 409, 412, 415

[56] References Cited

U.S. PATENT DOCUMENTS

| | | | |
|---|---|---|---|
| 3,503,067 | 3/1970 | Amiragoff | 340/412 |
| 3,725,865 | 4/1973 | Fairchild | 340/172 |

*Primary Examiner*—Alvin H. Waring

*Attorney, Agent, or Firm*—Hubbard, Thurman, Turner, Tucker & Glaser

[57] ABSTRACT

An alarm detection and identification system capable of detecting one or more alarms at remote sites and capable of identifying at a detection and identification station which remote sites have had alarms is disclosed. In one embodiment, the electrical signals necessary to distinguish between many remote sites can be carried along a single pair of transmission wires by using distinctive analog addresses for the various remote sites. Also, the system uses only a minimum of energy during non-alarm situations, and thus, can be battery operated. Additionally, the analog address currents are additive, allowing any number of remote sites to be added to the system.

9 Claims, 4 Drawing Figures

ALARM DETECTION AND IDENTIFICATION SYSTEM

The present invention relates generally to security alarm systems and, in one of its aspects, to apparatus and methods for determining which of various remote alarm sites have been activated. Monitoring many locations for certain alarm situations such as burglaries or fires require some method of distinguishing between the various locations. Human monitoring remote sites is slow and expensive; methods of electronically monitoring remote sites for alarm activation have therefore been developed. Often it is desirable to be able to wire the various monitoried sites in parallel along a single pair of wires, such as by a telephone line or by lines found in an existing office building where there is a limited amount of pre-strung wire available, or for off-shore work where the total amount of wiring needs to be kept to a minimum. Additionally, it is desirable that such systems be able to switch to non-commercial or battery power during emergency situations such as blow-outs or fire.

In the past, some wire line alarm detection and identifications systems such as shown in U.S. Pat. No. 3,821,733, have used analog address currents to identify each of various remote sites starting with some high quiescent current for noise rejection and subtracting the address currents in alarm situations. Due to the high quiescent current in the lines connecting the remote sites to the central detection station, these systems use considerable amounts of energy during non-alarm periods. Since the non-alarm situation is normal for most alarm detection systems, such systems are wasteful. Besides being wasteful, such systems are not well adapted to battery power. Additionally, only a fixed number of remote sites can be added to such a subtractive system before the analog address currents would reduce the total line current to zero, preventing the addition of additional remote sites.

Alarm detection systems that provide detection but which are incapable of distinguishing various remote sites along a single pair of lines have used current regulators at the remote sites to change the alternating current from a quiescent alternating current during non-alarm situations to some higher value of alternating current or half-wave rectified alternating current voltage source at the detection end of each pair of wires leading to a remote site. Such an A-C system might offer some advantages in transmission to extremely remote sites, but the frequency of the alarm signals have to be the same frequency as the driving voltage source, preventing frequency differentiation for different types of signals. Further, such an A-C system would not lend itself to easy detection and identification of many different current levels, nor could it be easily operated from a battery source.

SUMMARY OF THE INVENTION

The present invention provides a method and apparatus for the detection and identification of one or more alarms originating at sites remote from a detection and identification (or central) station. The method of the present invention provides a D-C voltage source at the detection station end of the pair of lines going to the various remote sites. During non-alarm and non-testing periods, practically no current is drained from the voltage source. During an alarm, the line voltage is used to generate an address current from the current source at the remote site which has experienced an alarm. Each address current is of a unique value, and in one embodiment, the address currents are of such value that no two or more address currents could be added to give a current equivalent to that of some other address current or combination of address currents. Thus, multiple alarms will not be mistaken for single alarms. Since the currents are additive and the current sources of the various remote lines are in parallel, any number of remote sites can be added to the system.

In addition to allowing any number of remote sites to be added to the same system, an entire system can be battery operated since the power supply is direct current and the current drainage during non-alarm situations is small. This means that an entire alarm detection and identification system can be located at remote sites where commercial power is not available. Such an alarm detection and identification system is obviously very useful for remote locations and temporary sites, such as construction sites or buoys on an off-shore project.

Since such a system can be battery operated, it is very useful for situations in which commercial power is likely to fail, such as during a fire. Thus, this system could be battery operated for smoke detection throughout a large building.

DESCRIPTION OF THE DRAWINGS

A more complete understanding of the invention may be had by referring to the following detailed description when taken in conjunction with the accompanying drawings, wherein.

DETAILED DESCRIPTION

Figure 1:
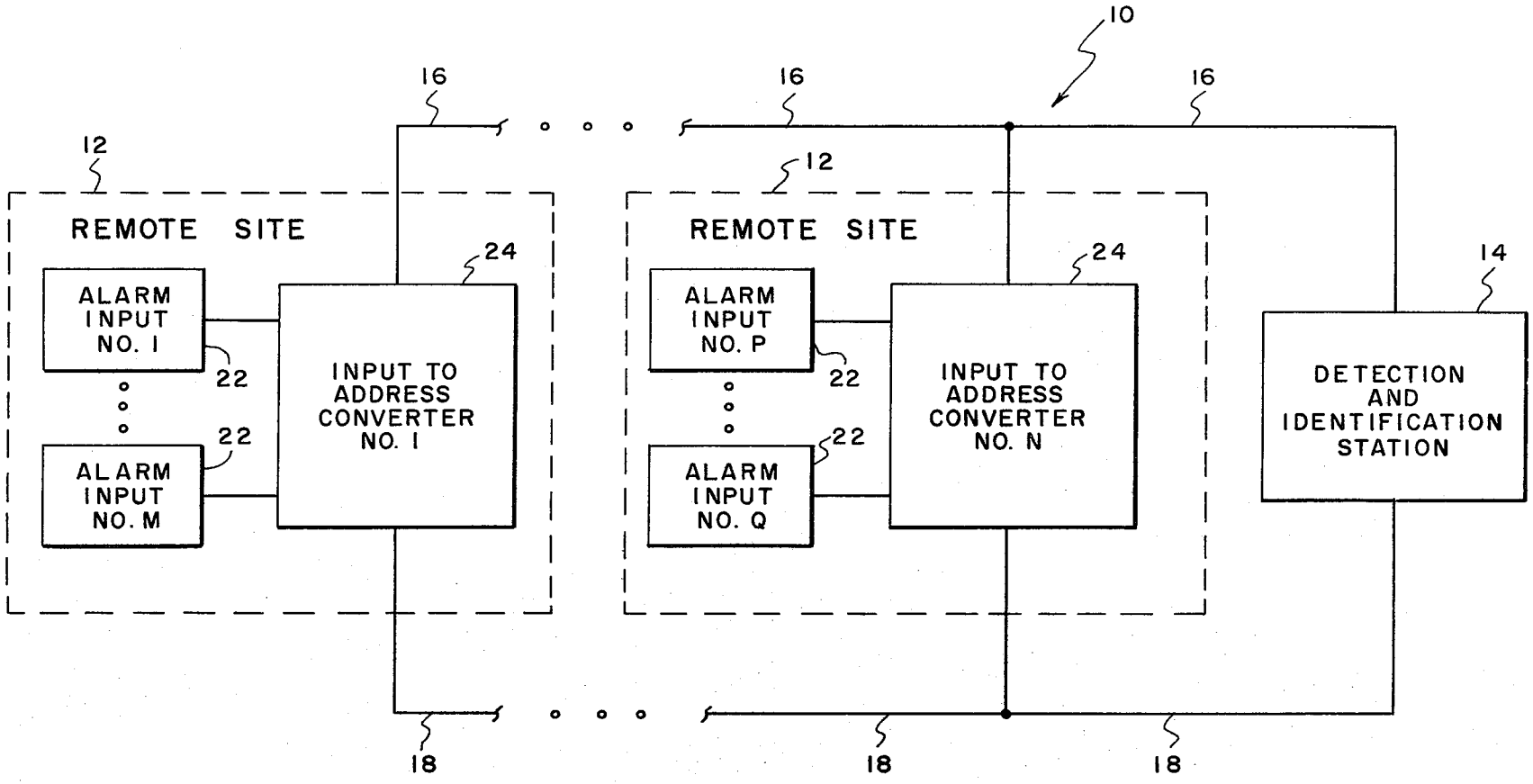
FIG. 1 is a schematic representation of an alarm detection and identification system incorporating the preferred embodiment of the invention.

Referring now to the drawings, and particularly to FIG. 1 thereof, an alarm detection and identification system employing the present invention is shown in block diagram form. The alarm detection and identification system 10 comprises remote sites 12, a detection and identification station 14, a pair of transmission lines 16 and 18 for transmitting power from the detection and identification station 14 to the remote site 12, and returning and transmitting analog current addresses to the detection and identification station 14. Line 18 may, for example, be at lower ground potential with respect to line 16. Each remote site 12 includes alarm inputs 22 which signal the existence of an alarm, and input to address converters 24, which detect the alarm signals and translate them into appropriate analog current addresses. The input to address converters are powered by a d-c voltage supplied from the detection and identification station power supply along lines 16 and 18, and during alarm situations, generate analog address currents along lines 16 and 18.

Figure 2:
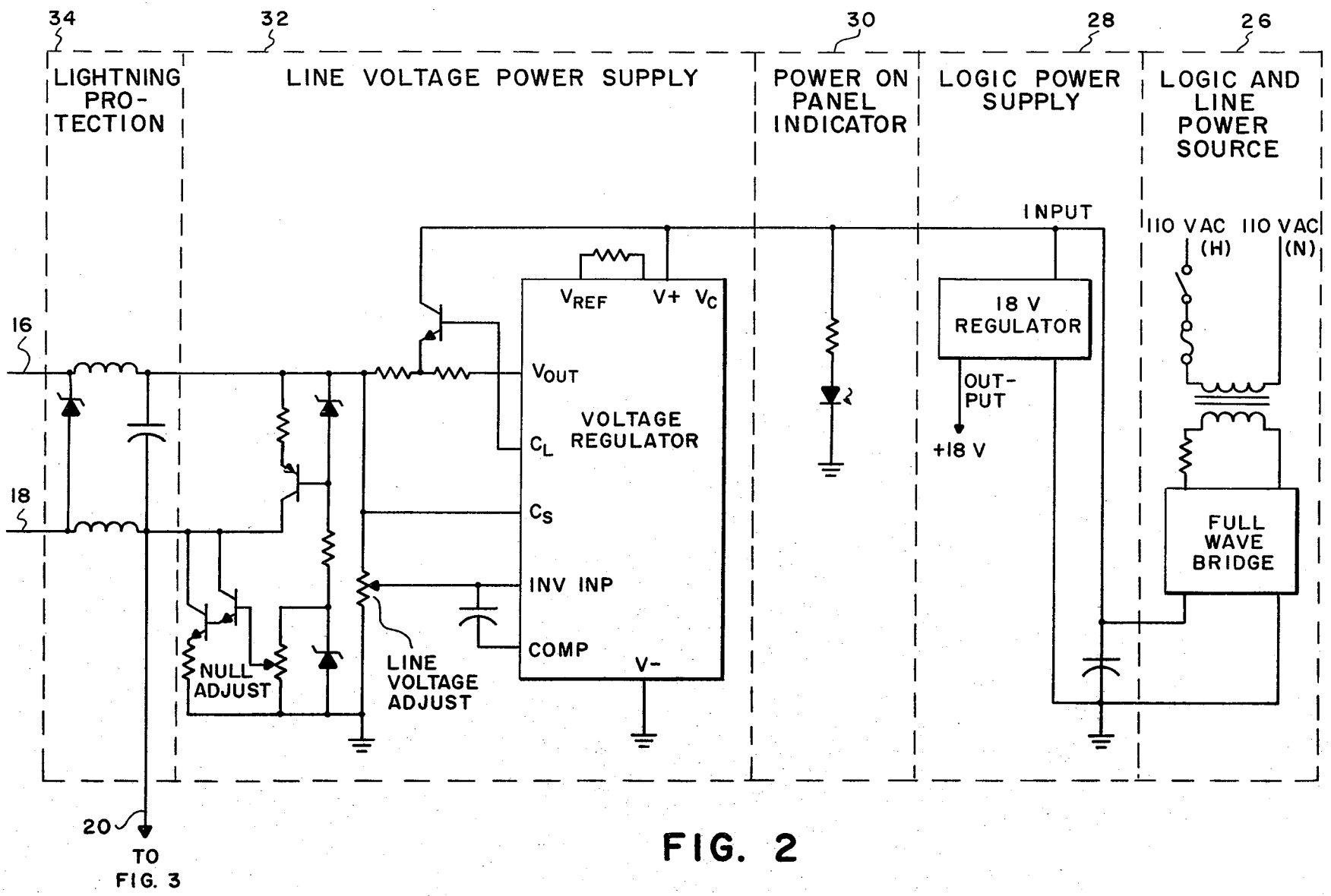
FIG. 2 is a schematic illustration of one form of a power supply utilized with the system illustrated in FIG. 1.

The detection and identification station 14 comprises a power supply and a detection and identification device. A schematic diagram of one embodiment of the central detection station power supply is illustrated in FIG. 2. Since the power supply illustrated in FIG. 2 merely generates d-c levels with lightning protection, all of the power supply illustrated except for the lightning protection can be replaced by a battery or batteries. This embodiment of the power supply comprises a logic and line power source 26, a logic power supply 28 for providing the logic levels needed by the detection and identification device, a power indicator 30 to provide a visual indication that power is being supplied to the system, a line voltage power supply 32 to regulate the D-C voltage supplied to line 16, and a lightning protection circuit 34. An address return line 20 is provided to conduct the address current of an alarm to the detection and identification device illustrated in FIG. 3.

Figure 3:
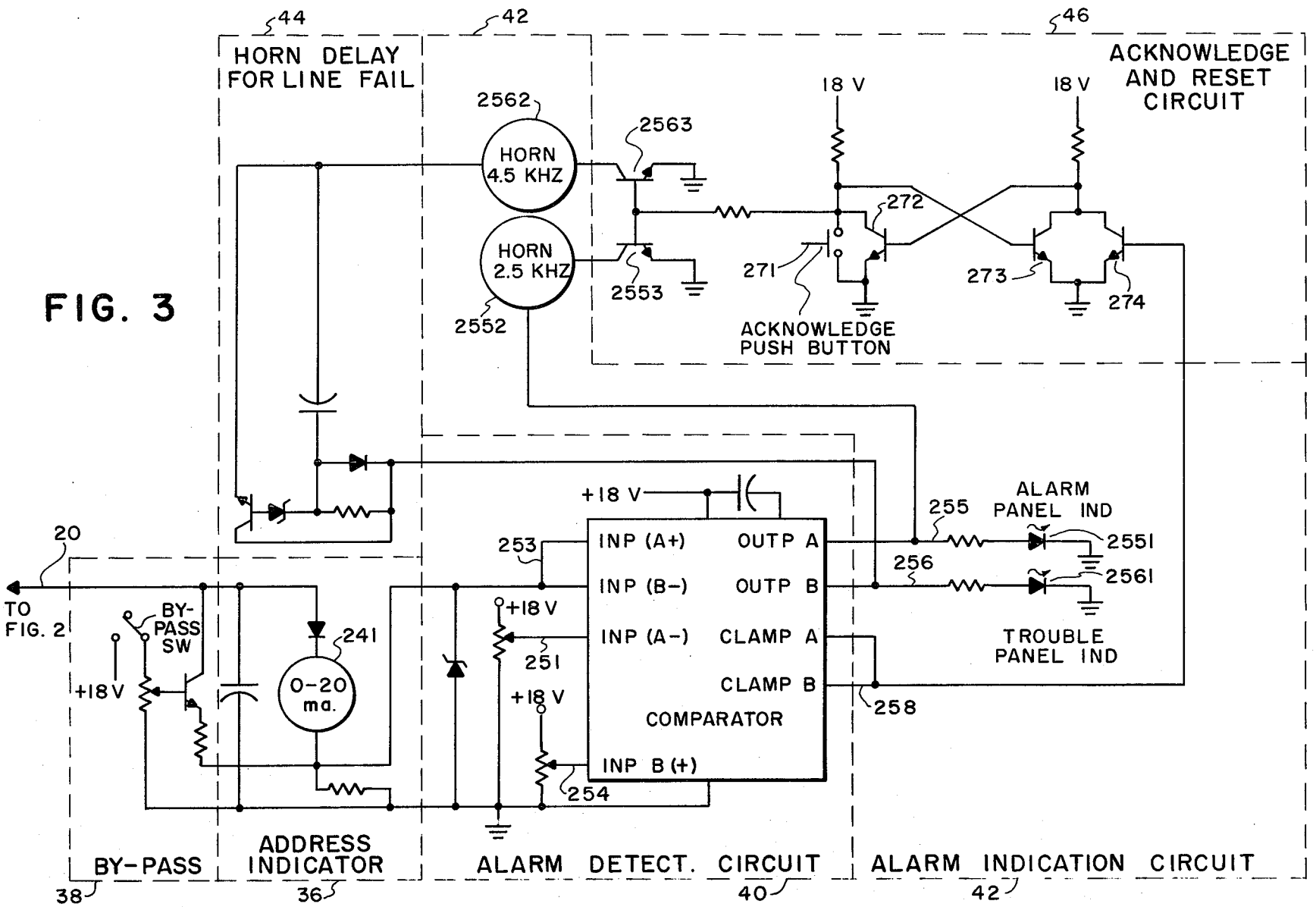
FIG. 3 is a schematic illustration of the details of one form of a detection and identification device for use in the detection and identification station of the system illustrated in FIG. 1.

Referring now to FIG. 3, the detection and identification device comprises an address indicator 36 for indentifying which of various remote alarm sites 12 has been activated, by-pass 38 for shunting a predetermined amount of current past the address indicator meter 241, an alarm detection circuit 40 to compare the voltage across the address indicator to certain predeterined voltages, an alarm indication circuit 42 for interpreting the output of the alarm detection circuit and giving the appropriate audio or visual displays to indicate the condition of the system, including the condition of the remote sites, a horn delay for line fail 44, and an acknowledge and reset circuit 47.

Figure 4:
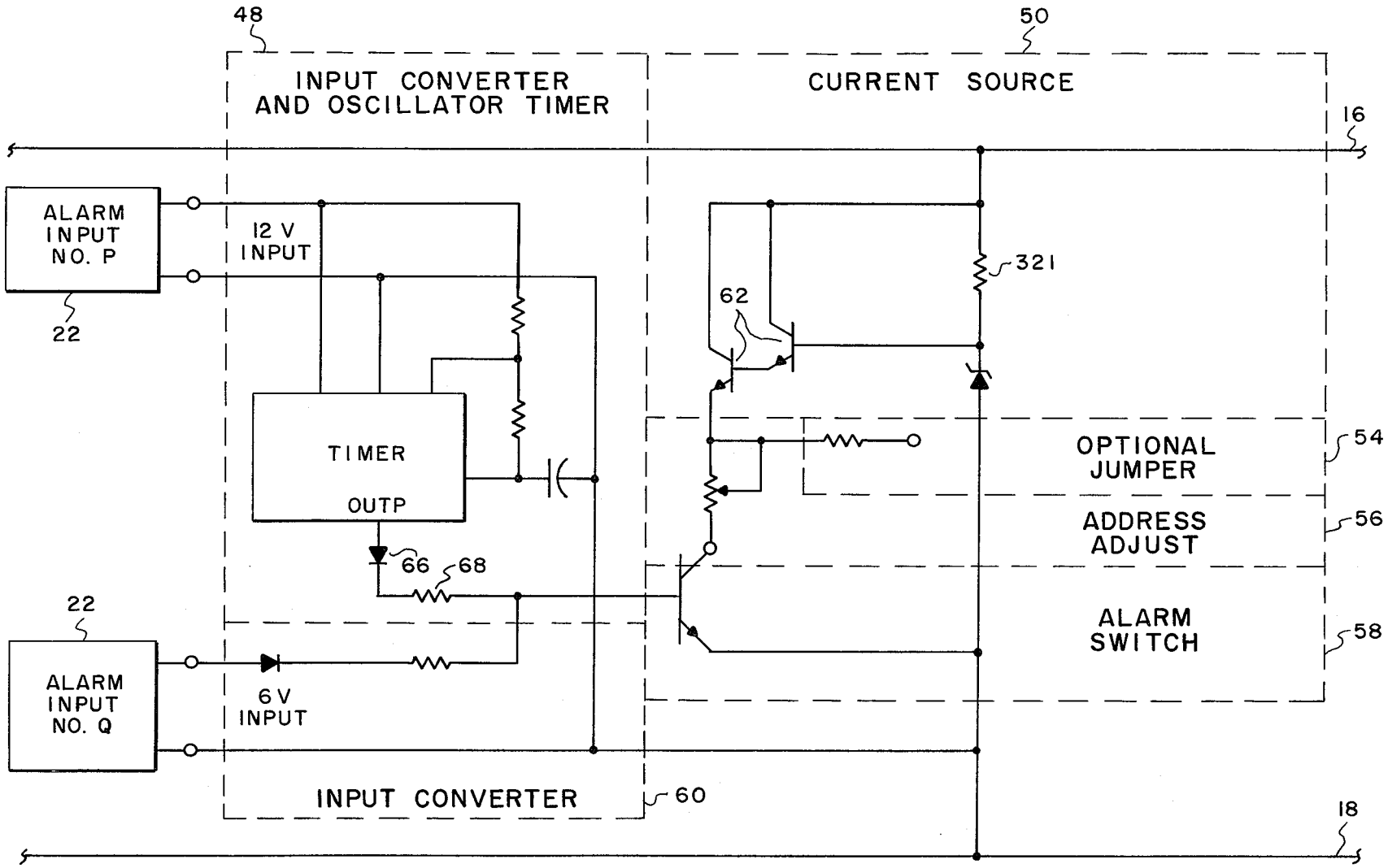
FIG. 4 is a schematic illustration of the details of one form of the remote sites utilized with the preferred embodiment of this invention illustrated in FIG. 1.

One embodiment of a remote site 12 is shown schematically in FIG. 4. The remote site comprises alarm inputs 22 and an input to address converter 24 which includes an input converter and oscillator timer 48 for converting a positive alarm input into an A-C current signal, an input converter 60 for converting a positive alarm input into a D-C current signal, and a current source 50 for generating a suitable address current upon receiving a current signal indicating an alarm condition. The input to address converter also comprises an optional jumper 54, an address adjust 46 for providing a unique address for each remote site, an alarm switch 58 for actuating the current source during alarm situations. The input converter and oscillator timer 48 of this embodiment includes a timer 64 for converting the alarm input 22 to an A-C voltage and a converter comprising a diode 66 and a resistor 68 for converting the A-C output of the timer 64 into a half-wave rectified current suitable as an input for alarm switch 58.

An alarm input 22 in this embodiment can be any suitable means for generating a voltage input in an alarm situation, such as a mechanical relay or electronic switch in series with a voltage source.

A D-C alarm input into the input converter 60 will result in a D-C current input to the alarm switch 58. On the other hand, a D-C alarm input into the input converter and oscillator timer will result in a pulsed or halfway rectified input current to the alarm switch 58. In either case during a positive input current, the alarm switch 58 will conduct, actuating the current source 50. The current supplier in this embodiment includes a two-transistor beta multiplier 62 for generating a quick and strong current response when alarm switch 58 is turned on. The address adjust 56 will be set so that the current generated will indicate that this particular-remote site is the one experiencing an alarm condition. The alarm address current will be generated onto the lines 16 and 18. The address current will proceed along the return line to the address return line 20 and then to the address indicator 36 where a visual signal will be generated to indicate which of the various remote sites has experienced an alarm. The current will also generate a voltage at node 253 which will be compared to the preset voltage 251 and 254. If the voltage at node 253 exceeds the preset voltage at node 251, then an alarm detection circuit output is generated at node 255 which lights alarm panel indicator 2551 and sounds the horn 2552 indicating an alarm condition at a remote site. Upon hearing the alarm or seeing the panel indicator, an operator can then examine the address indicator to determine which of the various remote sites is experiencing the alarm. In a testing mode, if the voltage at node 253 drops below the comparison voltage at node 254, an alarm detection circuit output voltage is generated at node 256 which lights the trouble panel indicator, and through a horn delay for line fail 44, sounds horn 2562.

The ammeter 241 of address indicator 36 should be such that it could be switched to peak-reading or capable of reading rootmean square if the remote sites are equipped with the input converter and oscillator timers 48.

During periods when there is no alarm and no line trouble, node 258 remains at ground potential so that transistor 274 does not conduct. The last preceding reset should have left transistor 273 not conducting and transistor 272 conducting so that the collector of transistor 272 is at a sufficiently low electrical potential as to not supply sufficient base current for transistors 2553 and 2563 to switch on. During an alarm or trouble situation, sufficient base current is supplied through 274 to turn the transistor on, which in turn lowers the base current into transistor 272 sufficiently to turn that transistor off, raising its collector voltage which in turn supplies sufficient base current to turn either transistor 2553 or 2563 or both on, i.e., into a conducting state, if there is sufficient voltage at either node 255 or 256. Transistor 221 of the line voltage power supply 32, in this embodiment acts as a current supply to help maintain the proper line voltage during alarm and trouble situations. Normally, the current drain necessary to maintain the line voltageis small, but the current source supply back-up transistor 221 helps with any transient supply problems created by switching.

Various means for testing current continuity throughout the system can also be incorporated. For instance, the quiescent current can be set at a different level for each remote site, providing easy identification in case of failure. Since quiescent current levels are normally low, a higher than normal voltage can be applied from the line voltage power supply for testing system continuity.

In another embodiment, the alarm horns could be replaced by telephone equipment which could automatically dial the fire department, police department, or maintenance facility. In such an embodiment, a prerecorded message could be transmitted to give the address of the detection and identification station, eliminating the need for human operators permanently stationed at each detection and identification station. Personnel could be dispatched to a detection and identification station when a failure occurs or an alarm is sounded.

From the foregoing, it will be seen that this invention is well adapted to obtain all of the ends and objects hereinabove set forth, and together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An alarm detection and identification system comprising, in combination:

a detection and identification station including a source of electrical power and means for responding to a plurality of different analog current address signals to provide a distinctive indication of each of said signals to distinguish it from any of the other of said signals;

a plurality of remote alarm stations each of which includes a means for generating an alarm signal in response to an alarm condition and a means powered by the source of electrical power for converting the alarm signal into an analog current address signal for identifying the particular remote station, each of said remote stations requiring relatively little power during non-alarm periods; and a means for electrically connecting each of the remote stations in parallel to the detection and identification station to supply electrical power to each of said remote stations, and to conduct said analog address signals to said detection and identification stations.

2. The alarm detection and identification system of claim 1 wherein the means for electrically connecting the remote stations in parallel to the detection and identification station comprises a single pair of transmission lines.

3. The alarm detection and identification system of claim 2 wherein said source of electrical current comprises a D-C voltage source.

4. The alarm detection and identification system of claim 3 wherein said means for responding to a plurality of different analog current address signals comprises a current indicating meter.

5. The alarm detection and identification station system of claim 4 wherein the possible address current range of the remote stations are increased by providing a means to by-pass the current indicating meter by a fixed amount of current.

6. The alarm detection and identification system of claim 1 wherein the means for converting the alarm signal into an analog current address signal for identifying the particular remote station comprises a current source, a means for adjusting the amount of current produced, means with the current source in series for activating the current source in response to the alarm signal.

7. A method of detecting and identifying at a central station alarms at remote stations including:

generating an alarm signal at each remote station that experiences an alarm condition;

converting the alarm signal into an analog current address signal unique to the particular remote station wherein the analog current address signal of each remote station is produced by a current source which is powered by a D-C voltage source located at the central station;

transmitting each analog current address signal in parallel with analog current address signals from other remote stations to the central station; and determining which of various remote stations have experienced alarms by comparing the amount of current received at the central station with the analog current addresses of the individual remote stations.

8. The method of detecting and identifying at a central station alarms at remote stations according to claim 7 wherein the D-C voltage source supplies power to the remote stations by a pair of transmission lines, and the analog current address signals are transmitted along the same transmission lines.

9. The method of detecting and identifying at a central station alarms at remote stations according to claim 7 wherein the analog current address signal of each remote station is not equal to any combination of analog current address signals of other remote stations and further including the step of determining which combination of various remote stations have experienced alarms by comparing the amount of current received at the central station with combinations of the analog current addresses of the individual remote stations.

* * * * *